US005995051A

United States Patent [19]

Sun

[11] Patent Number: 5,995,051

[45] Date of Patent: Nov. 30, 1999

[54] ROD ANTENNA FOR USE IN A PORTABLE TRANSMITTING / RECEIVING APPARATUS

[75] Inventor: Chong Hong Sun, Tochio, Japan

[73] Assignee: Harada Industry Co., Ltd, Tokyo, Japan

[21] Appl. No.: 08/986,261

[22] Filed: Dec. 5, 1997

[30] Foreign Application Priority Data

Dec. 5, 1996 [JP] Japan ..... 8-325308

[51] Int. Cl.[6] ..... H01Q 1/24

[52] U.S. Cl. ..... 343/702; 343/900

[58] Field of Search ..... 343/702, 895, 343/900, 901

[56] References Cited

U.S. PATENT DOCUMENTS 5,572,224 11/1996 Moller et al. ..... 343/895

5,678,201 10/1997 Thill ..... 343/895

5,835,065 11/1998 Wallace et al. ..... 343/702

*Primary Examiner*—Don Wong

*Assistant Examiner*—Hoang Nguyen

*Attorney, Agent, or Firm*—John P. White; Cooper & Dunham LLP

[57] ABSTRACT

The present invention provides a rod antenna for use in a portable transmitting/receiving apparatus. The rod antenna is housed in a case of the portable transmitting/receiving apparatus so as to be freely inserted thereinto and drawn therefrom and is electrically connected to a feeder section provided in the case. The rod antenna includes an antenna element having a column formed of insulating material and a conductive film formed on an outer surface of the column along a longitudinal direction of the column so as to have a predetermined length corresponding to transmitted/received waves.

4 Claims, 2 Drawing Sheets

ROD ANTENNA FOR USE IN A PORTABLE TRANSMITTING / RECEIVING APPARATUS

BACKGROUND OF THE INVENTION

The present invention relates to a rod antenna favorable for use in a portable transmitting/receiving apparatus such as a portable telephone and a portable terminal.

FIGS. 4 and 5 show a constitution of a prior art rod antenna used in a portable transmitting/receiving apparatus. FIG. 4 is a vertically sectional side view of the whole of the rod antenna, while FIG. 5 is also a vertically sectional side view of only the antenna element thereof.

The rod antenna 20 is freely inserted into a case 31 of the portable transmitting/receiving apparatus 30 and drawn therefrom, as indicated by the arrows in FIG. 4. The rod antenna 20 is also electrically coupled to a feeder section 32, provided near to an antenna inserting/drawing hole 31*a* of the case 31, using a certain coupling means.

As illustrate in FIG. 5, the antenna element 21, which is the principal part of the rod antenna 20, is constituted by supporting first and second conductive lines 23*a* and 23*b* each having a predetermined length by three insulating columns 22*a,* 22*b* and 22*c* such that the conductive lines and insulating columns are arranged in a straight line and separately from each other and then covering them with an insulating tube 24.

Returning to FIG. 4, in the antenna element 21 so constituted, its outer surface except both end portions is covered with an armoring tube 25 of insulating material. A bottom portion of the antenna element 21 is coated with a bottom-portion protecting cylinder 26*a* formed of insulating material, while a top portion thereof is coated with a cap 26*b* formed of insulating material. The rod antenna 20 is thus completed as illustrated in FIG. 4.

The above-described prior art rod antenna 20 has the following drawback. In order to form the antenna element 21 of the rod antenna 20, the first and second conductive lines 23*a* and 23*b* have to be positioned with high precision such that the conductive lines and three insulating columns 22*a,* 22*b* and 22*c* are arranged concentrically in the straight line, and they have to be molded using insulating molding materials such as resin and covered with the insulating tube 24. Since, therefore, the antenna element 21 is complicated in structure and requires a large number of parts, it cannot be miniaturized or lightened, thus making it difficult to manufacture the rod antenna and increasing in costs therefor.

BRIEF SUMMARY OF THE INVENTION

It is accordingly an object of the present invention to provide a rod antenna for use in a portable transmitting/receiving apparatus, which is simplified in structure and reduced in number of parts and ca thus be easily miniaturized and lightened, thereby decreasing in manufacturing costs.

To achieve the above object, according to the present invention, there is provided a rod antenna for use in a portable transmitting/receiving apparatus, which is housed in a case of the portable transmitting/receiving apparatus so as to be freely inserted thereinto and drawn therefrom and which is electrically connected to a feeder section provided in the case, wherein the rod antenna includes an antenna element having a column formed of insulating material and a conductive film formed on an outer surface of the column along a longitudinal direction of the column so as to have a predetermined length corresponding to transmitted/received waves.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments give below, serve to explain the principles of the invention.

DETAILED DESCRIPTION OF THE INVENTION

Embodiment

Figure 1:
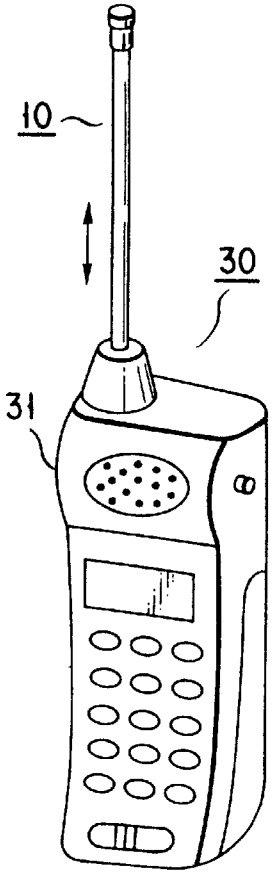
FIG. 1 is a perspective view of an outward appearance of a rod antenna for use in a transmitting/receiving apparatus according to an embodiment of the present invention, which is applied to a portable telephone.
Figure 2:
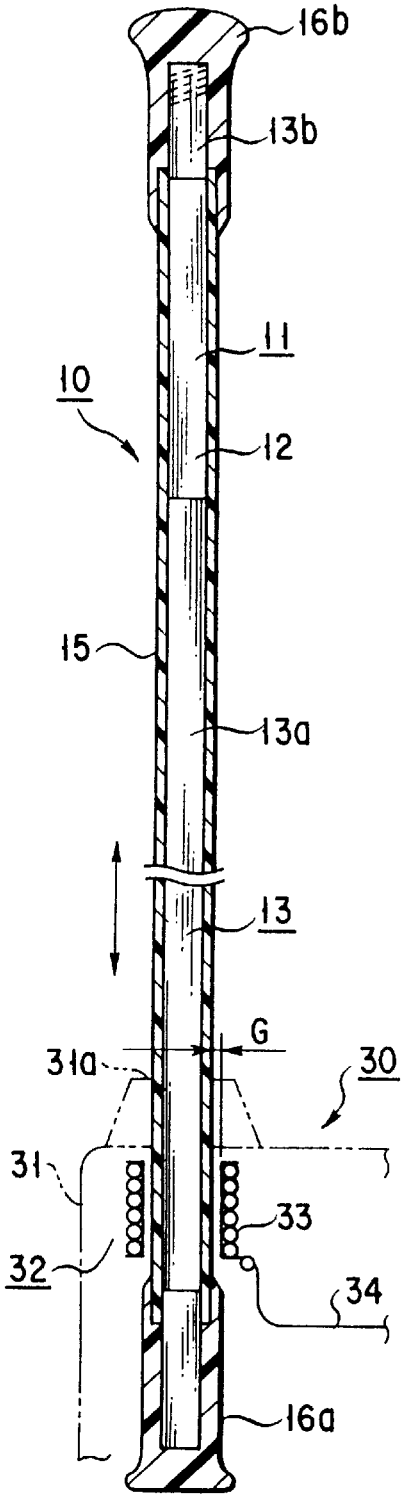
FIG. 2 is a vertically sectional side view of the entire rod antenna according to the embodiment of the present invention.
Figure 3:
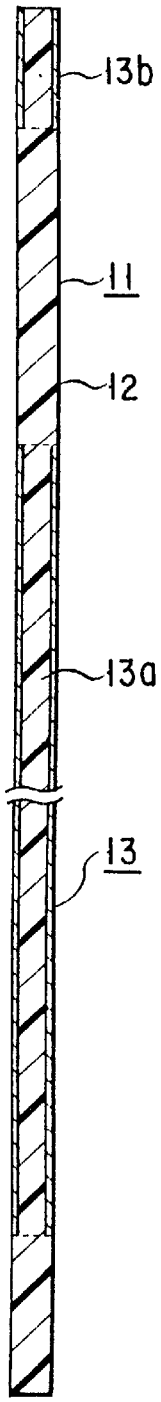
FIG. 3 is a side view of only the antenna element of the rod antenna according to the embodiment of the present invention.
Figure 4:
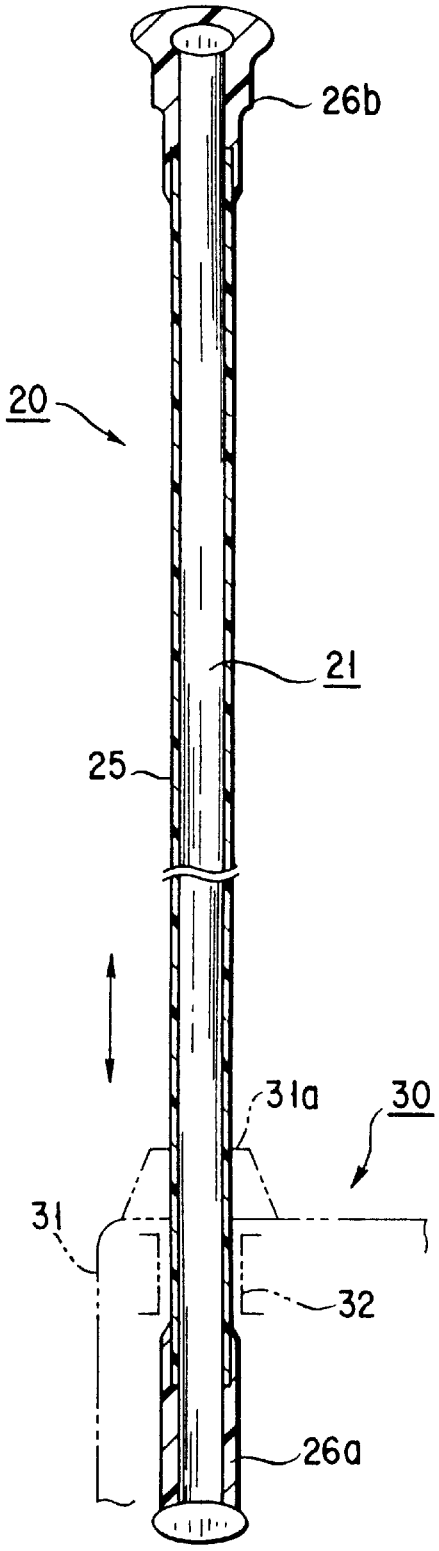
FIG. 4 (PRIOR ART)
FIG. 4 is a vertically sectional side view of the whole of a prior art rod antenna.
Figure 5:
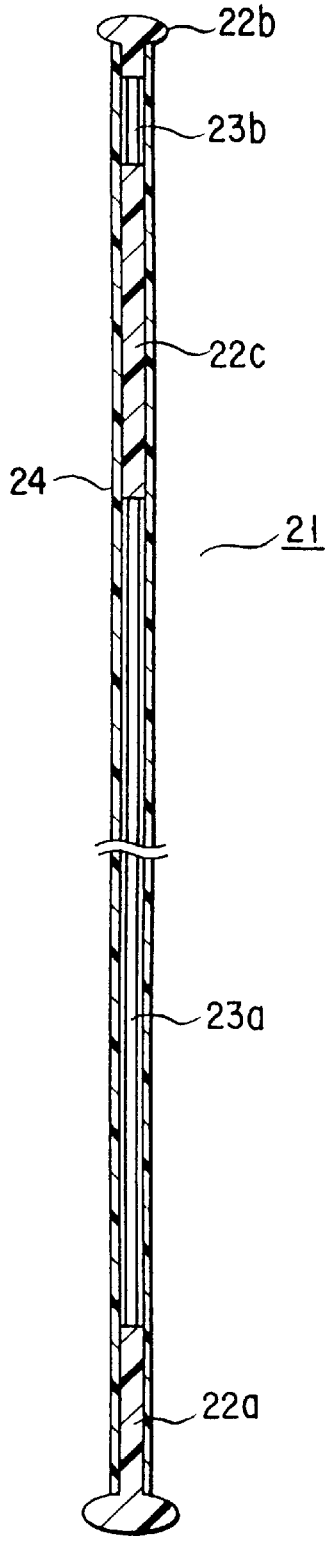
FIG. 5 (PRIOR ART)
FIG. 5 is a vertically sectional side view of only the antenna element of the prior art rod antenna.

FIGS. 1 to 3 illustrate a constitution of a rod antenna for use in a portable transmitting/receiving apparatus according to an embodiment of the present invention.

The rod antenna 10 is freely inserted into a case 31 of a portable telephone 30 and drawn therefrom, as indicated by the arrows in FIGS. 1 and 2. The rod antenna 10 is also electrically coupled to a feeder section 32 provided in the case 31 by an electrostatic coupling means 33 (which will be described later).

As illustrated in FIG. 3, the antenna element 11 serving as a main part of the rod antenna 10 is so constituted that a conductive film 13 including first and second conductive films 13*a* and 13*b* is formed on the outer surface of a single column 12 of insulating material such as resin, along the longitudinal direction of the column 12 so as to have a length corresponding to transmitted/received waves.

The conductive film 13 is formed by, e.g., plating and evaporation using copper and other metal.

For materials of the column 12, polyacetal (POM), polycarbonate (PC), etc. are favorable since they have flexibility, curvature and restoration.

Returning to FIG. 2, almost all the outer surface of the antenna element 11 except both end portions thereof is covered with an armoring tube 15 formed of insulating material. A bottom portion of the antenna element 11 (including a bottom portion of the armoring tube 15 and projected therefrom) is coated with a bottom-portion cap 16*a* of insulating material, while a top portion thereof (including a top portion of the armoring tube 15 and projected therefrom) is coated with a top-portion cap 16*b* formed of insulating 5 material. The rod antenna 10 is thus completed as illustrated in FIG. 2.

Polypropylene (PP) is favorable for the materials of the caps 16*a* and 16*b* since it is easy to treat for molding.

The conductive film 13 is electrostatically coupled to the feeder section 32 of the case 31. In other words, a conductive coil (or a conductive sleeve) 33 is provided in the vicinity of an antenna inserting/drawing hole 31*a* of the case 31. The conductive coil 33 is so arranged that its inner surface is opposed to the outer surface of the first conductive film 13*a* or the second conductive film 13*b* with a slight gap G therebetween when the antenna element 11 is inserted into the conductive coil 33. The coil 33 is connected to an antenna connecting terminal (not shown) of a transmitting/receiving circuit through a feeder 34.

When the rod antenna 10 is drawn from the case 31 of the portable telephone 30, the first conductive film 13*a,* which is formed at one end portion of the column 12 of insulating material, is electrostatically coupled to the feeder section 32 to serve mainly as a transmitting/receiving antenna element. When the antenna 10 is housed in the case 31, the second conductive film 13*b*, which is formed at the other end portion of the column 12, is electrostatically coupled to the feeder section 32 to serve mainly as an incoming call antenna element.

In the foregoing rod antenna 10, the antenna element 11 is obtained by forming the column 12 and conductive film 13 constituted of the first and second conductive films 13*a* and 13*b,* integrally with each other as one component by plating the outer surface of the column 12 with copper. As compared with the prior art antenna in which the antenna element is formed by arranging three insulating columns and two conductive lines alternately in a straight line and coating them with the insulating tube, the antenna 10 of the present invention is simpler in structure, requires a smaller number of parts, and is easier to miniaturize and lighten. Furthermore, the antenna 10 can easily be manufactured at lower cost since it is unnecessary to perform an operation of positioning the first and second conductive films 13*a*, 13*b* with high precision or the like.

Since the conductive film 13 and feeding section 32 are electrostatically coupled to each other, they requires no coupling mechanism for mechanically coupling them, with the result that the structure of the antenna element 11 is simplified as shown in FIG. 3 and accordingly that of the rod antenna 10 can be done greatly. Consequently, it is very easy to manufacture the rod antenna 10 itself and incorporate it into the portable telephone 30. Needless to say, since the conductive film 13 and feeder section 32 do not contact each other due to the electrostatic coupling, no contact failure will occur even though the antenna is used over a long period.

As described above, when the rod antenna 10 is drawn from the case 31 of the portable telephone 30, the first conductive film 13*a* serves as a transmitting/receiving antenna element and, when the antenna 10 is housed in the case 31, the second conductive film 13*b* serves as an incoming call antenna element. Therefore, even while the antenna element 11 is housed in the case 31, the rod antenna 10 has reception sensitivity capable of sufficiently responding to a call signal and fulfills an incoming call function favorable for the portable telephone 30.

Modifications

The following are modifications to the rod antenna of the above embodiment:

1) At least part (part of the first conductive film 13*a* and/or the second conductive film 13*b*) of the conductive film 13 has a helical pattern which is used for a helical antenna element, a loading coil and the like.

2) The rod antenna is applied to a portable terminal.

Merits of the Embodiment and Modifications

The rod antenna for use in a portable transmitting/receiving apparatus according to the above embodiment and modifications, have structures and advantages as described below.

(1) The rod antenna 10 is housed in a case 31 of a portable transmitting/receiving apparatus 30 so as to be inserted thereinto and drawn therefrom and it is electrically connected to a feeder section 32 provided in the case 31. The rod antenna comprises an antenna element 11 including a column 12 formed of insulating material and a conductive film 13 formed on the outer surface of the column 12 along the longitudinal direction of the column 12 so as to have a predetermined length corresponding to transmitted/received waves.

In the foregoing rod antenna 10, the antenna element 11 has only to be constituted by forming the column 12 and conductive film 13 integrally with each other as one component by plating the outer surface of the column 12 with copper or the like. Therefore, as compared with the prior art antenna in which the antenna element is obtained by coating a plurality of columns and conductive lines, which are arranged and connected in a straight line, with the insulating tube, the antenna 10 is considerably simpler in structure, requires a smaller number of parts, and is easier to miniaturize and lighten. The antenna ca thus be manufactured at lower cost.

(2) In the rod antenna 10 described in above (1), the conductive film 13 is electrostatically coupled to the feeder section 32.

This rod antenna 10 has the same advantage as that of the antenna of above (1). Since, furthermore, it requires no coupling mechanism for causing the conductive film 13 and feeder section 32 to mechanically contact each other, its structure can be more simplified, and the antenna can easily be manufactured and incorporated into the portable transmitting/receiving apparatus. Furthermore, no contact failure will occur even though the antenna is used over a long period.

(3) In the rod antenna 10 described in above (1), the conductive film 13 is constituted of a first conductive film 13*a* formed at one end portion of the column 12 of insulating material and a second conductive film 13*b* formed at the other end portion of the column 12. When the antenna 10 is drawn from the case 31 of the portable transmitting/receiving apparatus 30, the first conductive film 13*a* serves as an antenna element 11. When the antenna 10 is housed in the case 31, the second conductive film 13*b* serves as an antenna element 11.

This rod antenna 10 has the same advantage as that of the antenna of above (1). Furthermore, even while the rod antenna 10 is housed in the case 31, it has reception sensitivity capable of sufficiently responding to a call signal and fulfills an incoming call function favorable for the portable transmitting/receiving apparatus 30.

(4) In the rod antenna 10 described in above (1), the conductive film 13 has a helical pattern in which at least part of the film 13 is helically wound on the outer surface of the column 12 at predetermined pitches.

This rod antenna 10 has the same advantage as that of the antenna of above (1). Since, furthermore, the helical pattern is able to serve as a helical antenna element, a loading coil, a trap coil and the like, an antenna having a special function using such can be achieved.

Additional advantages and modifications will readily occurs to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

I claim:

1. A rod antenna for use in a portable transmitting/receiving apparatus, said rod antenna being housed in a case of the portable transmitting/receiving apparatus so as to be freely inserted thereinto and drawn therefrom and being electrically connected to a feeder section provided in the case, said rod antenna comprising:

a column formed of insulating material;

a first conductive film cylindrically formed around an outer surface of one end portion of the column along a longitudinal direction of the column so as to have a predetermined length corresponding to one transmitted/received wave; and a second conductive film cylindrically formed around an outer surface of another end portion of the column along the longitudinal direction of the column so as to have a predetermined length corresponding to another transmitted/received wave, wherein when the rod antenna is drawn out of the case of the portable transmitting/receiving apparatus, an outer surface of the first conductive film is electrically coupled to the feeder section to fulfill an antenna function in the first conductive film and, when the rod antenna is housed in the case, an outer surface of the second conductive film is electrically coupled to the feeder section to fulfill an antenna function in the second conductive film.

2. A rod antenna according to claim 1, wherein the first conductive film serves as a transmitting/receiving antenna element and the second conductive film serves as an incoming call antenna element.

3. A rod antenna for use in a portable transmitting/receiving apparatus, said rod antenna being housed in a case of the portable transmitting/receiving apparatus so as to be freely inserted thereinto and drawn therefrom and being electrostatically connected to a feeder section provided in the case, said rod antenna comprising:

a column formed of insulating material;

a first conductive film cylindrically formed around an outer surface of one end portion of the column along a longitudinal direction of the column so as to have a predetermined length corresponding to one transmitted/received wave;

a second conductive film cylindrically formed around an outer surface of another end portion of the column along the longitudinal direction of the column so as to have a predetermined length corresponding to another transmitted/received wave; and an armoring tube formed of insulating material so as to cover an outer surface of the first conductive film and an outer surface of the second conductive film, wherein when the road antenna is drawn out of the case of the portable transmitting/receiving apparatus, the outer surface of the first conductive film is electrostatically coupled to the feeder section through the armoring tube to fulfill an antenna function in the first conductive film and, when the rod antenna is housed in the case, the outer surface of the second conductive film is electrostatically coupled to the feeder section through the armoring tube to fulfill an antenna function in the second conductive film.

4. A rod antenna according to claim 3, wherein the first conductive film serves as a transmitting/receiving antenna element and the second conductive film serves as an incoming call antenna element.

* * * * *